US012604937B2

(12) United States Patent
Hovest et al.

(10) Patent No.: US 12,604,937 B2
(45) Date of Patent: Apr. 21, 2026

(54) TRAINING GLOVES FOR TEACHING CHILDREN TO TYPE

(71) Applicants: Christine Hovest, Findlay, OH (US); Patricia Donkers, Santa Monica, CA (US)

(72) Inventors: Christine Hovest, Findlay, OH (US); Patricia Donkers, Santa Monica, CA (US)

( * ) Notice: Subject to any disclaimer, the term of this patent is extended or adjusted under 35 U.S.C. 154(b) by 825 days.

(21) Appl. No.: 17/731,663

(22) Filed: Apr. 28, 2022

(65) Prior Publication Data

US 2022/0346475 A1 Nov. 3, 2022

Related U.S. Application Data

(60) Provisional application No. 63/180,708, filed on Apr. 28, 2021.

(51) Int. Cl.
*A41D 19/00* (2006.01)

(52) U.S. Cl.
CPC ..... *A41D 19/00* (2013.01)

(58) Field of Classification Search
CPC . A41D 19/00; A41D 19/0013; A41D 19/0024
See application file for complete search history.

(56) References Cited

U.S. PATENT DOCUMENTS 4,519,781 A * 5/1985 Boyd ..... G09B 21/009 2/160
5,655,910 A * 8/1997 Troudet ..... G09B 19/00 434/233
6,029,277 A * 2/2000 Picchione, II ... A41D 19/01582 602/14

(Continued)

FOREIGN PATENT DOCUMENTS

AU 2002100378 A4 * 6/2002
CN 2747913 Y 12/2005

(Continued)

OTHER PUBLICATIONS

Senden Y, Gloves With Keyboard Input Characters (translation), Jul. 15, 2004 (Year: 2004).*

(Continued)

*Primary Examiner* — Dmitry Suhol
*Assistant Examiner* — Jose Angeles
(74) *Attorney, Agent, or Firm* — Jacob M. Ward; Ward Law Office LLC

(57) ABSTRACT

A typing training system includes a first glove. The first glove can include a main body having finger sheaths. Each of the finger sheaths can be configured to receive a finger from a user. The main body can further include a dorsal side and a palmar side. The dorsal side can have a first set of characters disposed thereon. The palmar side can have a second set of characters disposed thereon. Each character of the first set and the second set can correspond to and be disposed adjacent to one of the finger sheaths. A kit for learning to type includes a pair of training gloves and a plurality of adhesive decals. A method of learning to type includes providing the pair of training gloves. Practicing typing with the training gloves in a first configuration. Reversing the gloves and practice typing with the gloves in the second configuration.

20 Claims, 5 Drawing Sheets

(56) References Cited

U.S. PATENT DOCUMENTS

| | | | | |
|---|---|---|---|---|
| 8,495,764 | B2 | 7/2013 | Hull | |
| 2019/0307186 | A1* | 10/2019 | Ruiz | A41D 19/0041 |

FOREIGN PATENT DOCUMENTS

| | | | | |
|---|---|---|---|---|
| CN | 209346149 | U | * | 9/2019 |
| JP | 2004199635 | A | * | 7/2004 |

OTHER PUBLICATIONS

Zhang Q, Pair of keyboard key mnemonic gloves (translation), Sep. 6, 2019 (Year: 2019).*
Ireland M, Touch-typing teaching method and teaching aid, Jun. 13, 2002 (Year: 2002).*
Written Opinion of the International Searching Authority dated Jul. 25, 2022.
http://touchtypers.com/, Date: N/A.

* cited by examiner

TRAINING GLOVES FOR TEACHING CHILDREN TO TYPE

CROSS-REFERENCE TO RELATED APPLICATIONS

This application claims the benefit of U.S. Provisional Application Ser. No. 63/180,708, filed on Apr. 28, 2021. The entire disclosure of the above application is incorporated herein by reference.

FIELD

The present disclosure relates to typing and, more particularly, to typing gloves.

INTRODUCTION

This section provides background information related to the present disclosure which is not necessarily prior art.

Typing is the process of writing or inputting text by pressing keys on a typewriter, computer keyboard, or touchscreen. Since the advent of the typewriter, typing skills have become more and more valuable. Recently, due to the global pandemic of COVID19, students and workers are increasingly performing duties remotely using a computer. These remote duties, which can include schoolwork or occupational work, can suffer greatly if the student/worker has poor typing skills.

Generally, "touch typing" has been the preferred technique for interfacing with a keyboard. With touch typing, the typist generally keeps their eyes fixated on the source copy. Touch typing involves the use of the home row method, where typists rest their wrist down with their fingers curved slightly and resting on a home row of keys, rather than lifting and typing (which can cause carpal tunnel syndrome).

Unfortunately, most novice typists utilize "hunting and pecking" techniques without formal typing training. Hunting and pecking involves the typist pressing each key individually (usually using only two fingers). Instead of relying on the memorized position of keys, the typist must find each key by sight. The use of this method can also prevent the typist from being able to see what has been typed without glancing away from the keys. Undesirably, this can cause typing errors to remain unnoticed due to the user not looking at the screen. There is also the disadvantage that because fewer fingers are used, those that are used are forced to move a much greater distance.

Many children and adults struggle to learn touch typing and instead utilize the hunting and pecking techniques. Traditional methods usually require repetitive practicing of typing for each key on the keyboard by the appropriate finger allocated to that key. Undesirably, while typing, the hands and fingers of the user can block the line of sight of the keys to the user, which prevents the user from knowing if each finger is resting on the appropriate key.

There is a continuing need for a training glove for typing. Desirably, the training glove can permit the user to quickly determine which keys are allocated to each finger.

SUMMARY

In concordance with the instant disclosure, training gloves for typing, which can permit the user to quickly determine which keys are allocated to each finger, have been surprisingly discovered.

In one embodiment, a typing training system can include a first glove. The first glove can include a main body having finger sheaths. Each of the finger sheaths can be configured to receive a finger from a user. The main body can further include a dorsal side and a palmar side. The dorsal side can have a first set of characters disposed thereon. The palmar side can have a second set of characters disposed thereon. Each character of the first set and the second set can correspond to and be disposed adjacent to one of the finger sheaths.

In another embodiment, a kit for learning to type can include a pair of training gloves and a plurality of adhesive decals, each of the decals can be configured to be removably disposed on one of the gloves. The pair of training gloves can include a first glove and a second glove. The first glove can include a main body having finger sheaths. Each of the finger sheaths can be configured to receive a finger from a user. The main body can further include a dorsal side and a palmar side. The dorsal side can have a first set of characters disposed thereon. The palmar side can have a second set of characters disposed thereon. Each character of the first set and the second set can correspond to and be disposed adjacent to one of the finger sheaths. The second glove can include a main body having finger sheaths. Each of the finger sheaths can be configured to receive a finger from a user. The main body can further include a dorsal side and a palmar side. The dorsal side can have a third set of characters disposed thereon. The palmar side can have a fourth set of characters disposed thereon. Each character of the third set and the fourth set can correspond to and be disposed adjacent to one of the finger sheaths.

In a further embodiment, a method of learning to type can include providing a pair of training gloves. The pair of training gloves can include a first glove and a second glove. The first glove can include a main body having finger sheaths. Each of the finger sheaths can be configured to receive a finger from a user. The main body can further include a dorsal side and a palmar side. The dorsal side can have a first set of characters disposed thereon. The palmar side can have a second set of characters disposed thereon. Each character of the first set and the second set can correspond to and be disposed adjacent to one of the finger sheaths. The second glove can include a main body having finger sheaths. Each of the finger sheaths can be configured to receive a finger from a user. The main body can further include a dorsal side and a palmar side. The dorsal side can have a third set of characters disposed thereon. The palmar side can have a fourth set of characters disposed thereon. Each character of the third set and the fourth set can correspond to and be disposed adjacent to one of the finger sheaths. The user can practice typing with the training gloves in a first configuration. The user can reverse the gloves to a second configuration, and practice typing with the gloves in the second configuration.

It should be appreciated that the training gloves can optionally include various methods for a user to test mastery of typing. These can include adhesive decals, which can be used to selectively cover certain characters on the gloves. It can also include turning the glove inside out to a third position, so that the user cannot see any characters. Advantageously, these methods of testing mastery can allow the user to slowly ween themselves off the training gloves as their typing skills improve.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 3:
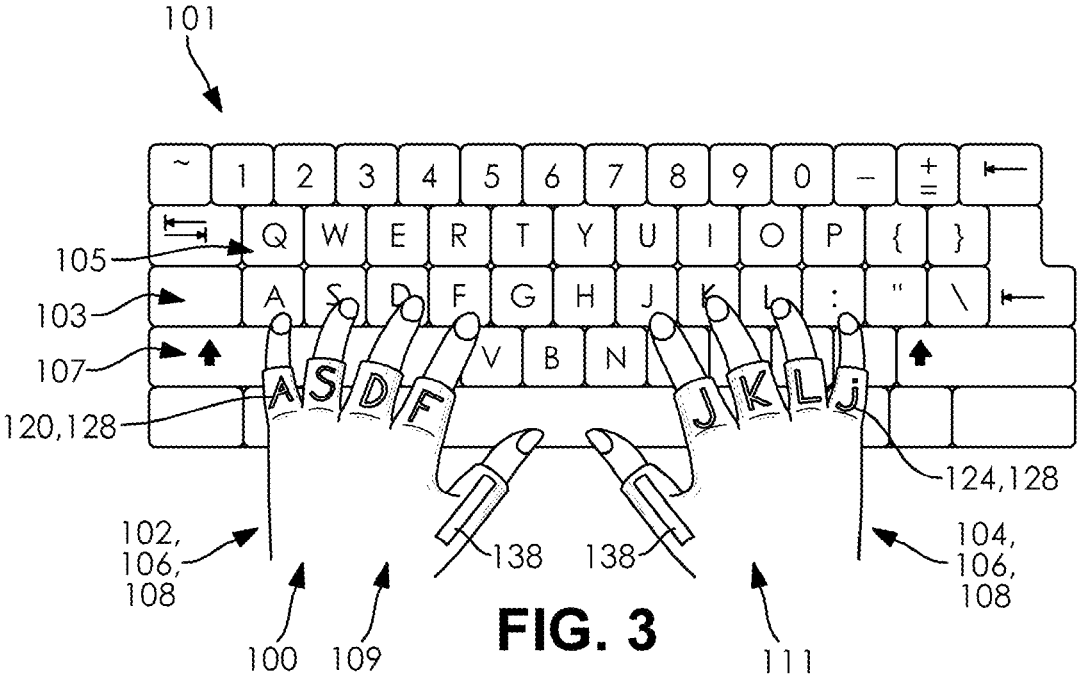
Figure 4:
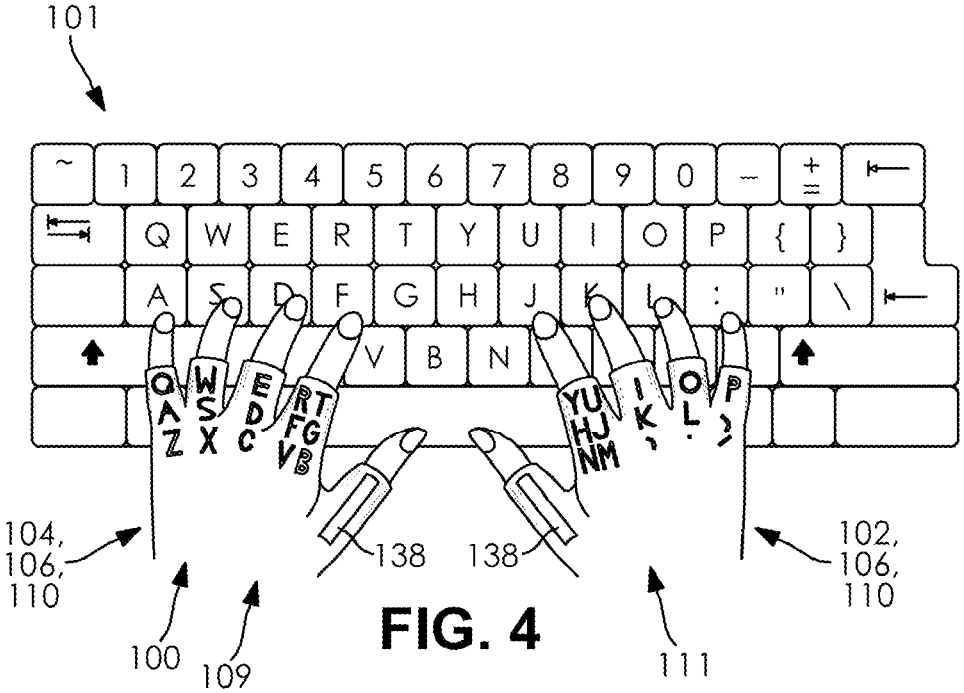
Figure 5:
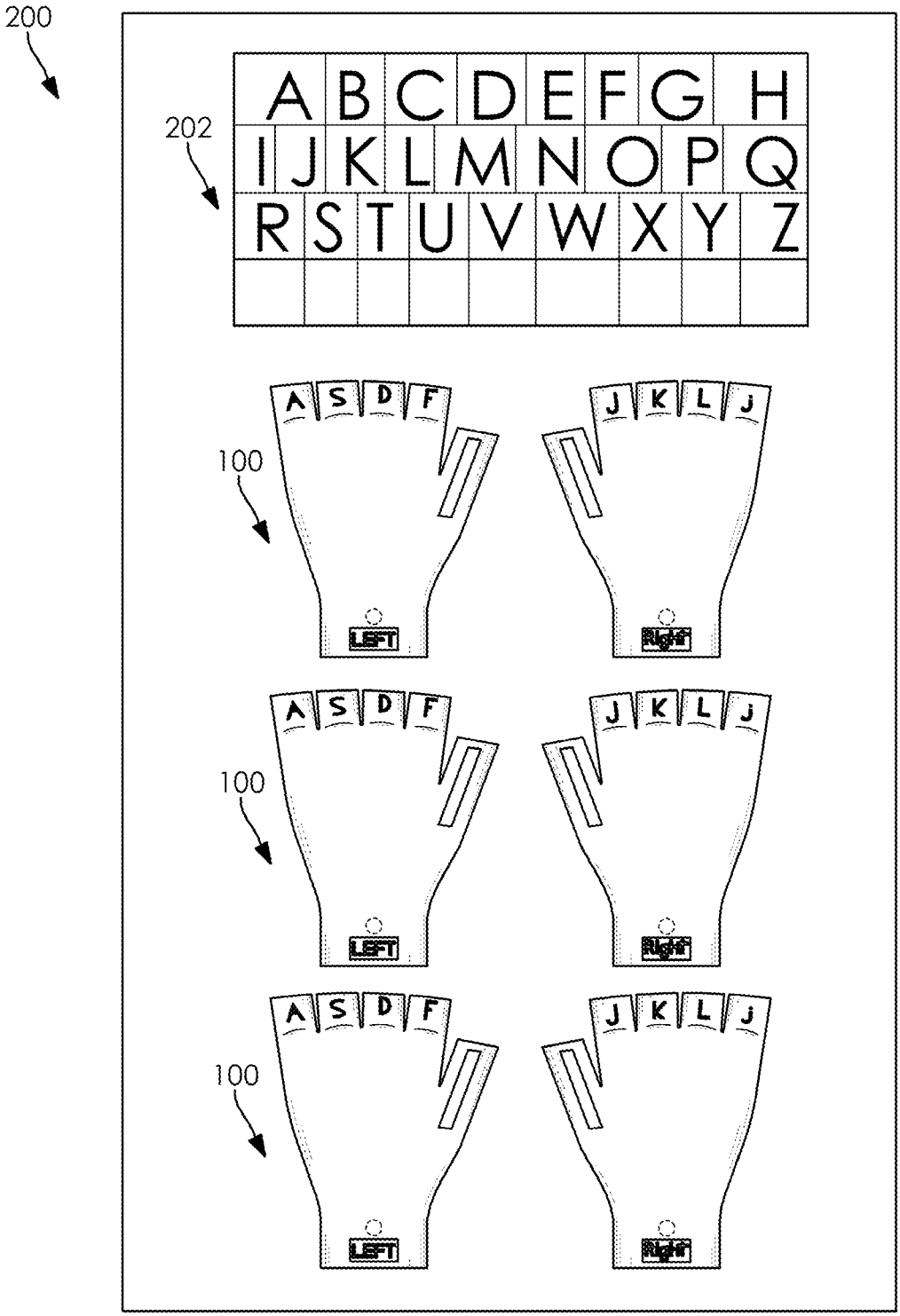
Figure 6:
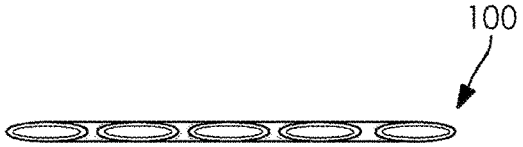
Figure 7:
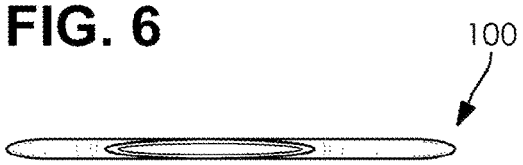
Figure 8:
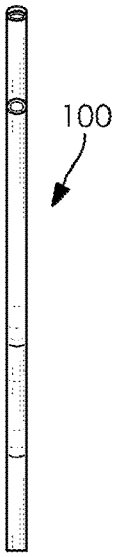
Figure 9:
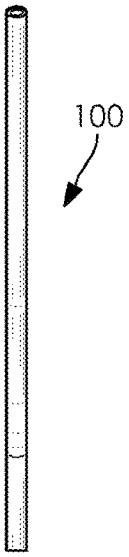
Figure 10:
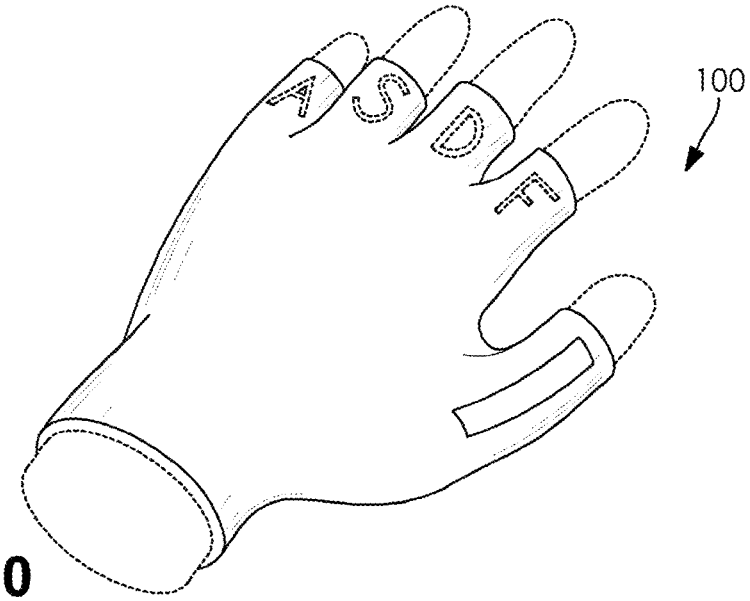

FIG. 3 a top plan view of training gloves for typing including the first glove and the second glove, with the gloves in the first configuration, further depicting the gloves in use according to a method of the present disclosure;

FIG. 4 a top plan view of training gloves for typing including the first glove and the second glove, with the gloves in the second configuration, further depicting the gloves in use according to a method of the present disclosure;

FIG. 5 is a top plan view of a kit for learning to type, the kit including a plurality of pairs of training gloves and a plurality of adhesive decals;

FIG. 6 is a front elevational view of the first glove;

FIG. 7 is a rear elevational view of the first glove;

FIG. 8 is a right elevational view of the first glove;

FIG. 9 is a left elevational view of the first glove;

FIG. 10 a top perspective view of the first glove; and

Figure 11:
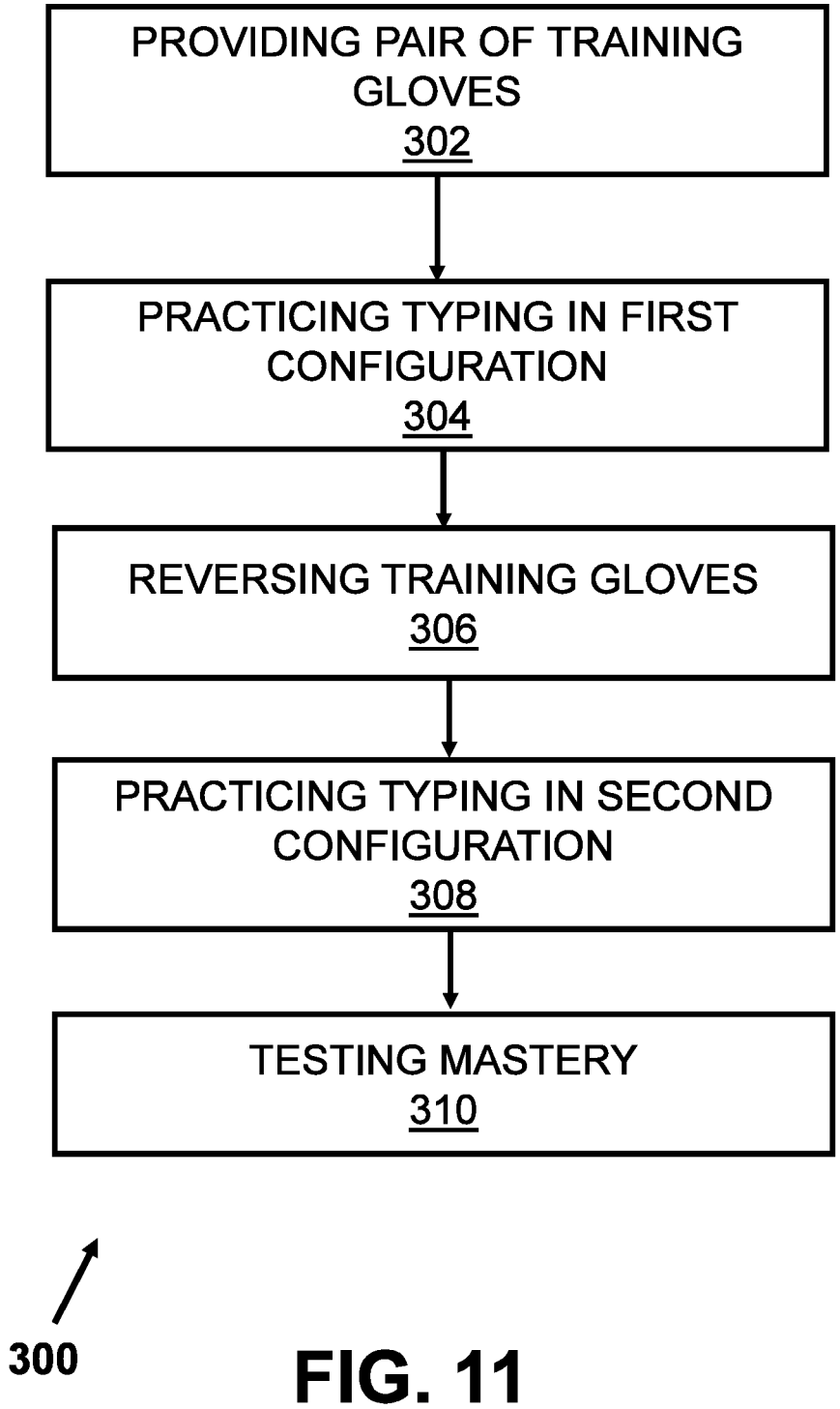

FIG. 11 is a flow chart depicting a method according to one embodiment of the present disclosure.

DETAILED DESCRIPTION

The following description of technology is merely exemplary in nature of the subject matter, manufacture, and use of one or more inventions, and is not intended to limit the scope, application, or uses of any specific invention claimed in this application or in such other applications as can be filed claiming priority to this application, or patents issuing therefrom. Regarding methods disclosed, the order of the steps presented is exemplary in nature, and thus, the order of the steps can be different in various embodiments, including where certain steps can be simultaneously performed.

The terms "a" and "an" as used herein indicate "at least one" of the item is present; a plurality of such items can be present, when possible. Except where otherwise expressly indicated, all numerical quantities in this description are to be understood as modified by the word "about" and all geometric and spatial descriptors are to be understood as modified by the word "substantially" in describing the broadest scope of the technology. The term "about" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that can arise from ordinary methods of measuring or using such parameters.

Although the open-ended term "comprising," as a synonym of non-restrictive terms such as including, containing, or having, is used herein to describe and claim embodiments of the present technology, embodiments can alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application.

Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter can define endpoints for a range of values that can be claimed for the parameter. For example, if Parameter X is exemplified herein to have value A and also exemplified to have value Z, it is envisioned that Parameter X can have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X can have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it can be directly on, engaged, connected, or coupled to the other element or layer, or intervening elements or layers can be present. In contrast, when an element is referred to as being "directly on," "directly engaged to," "directly connected to" or "directly coupled to" another element or layer, there can be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. can be used herein to describe various elements, components, regions, layers and/or sections, these elements, components, regions, layers and/or sections should not be limited by these terms. These terms can be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, can be used herein for ease of description to describe one element or feature's relationship to another element(s) or feature(s) as illustrated in the figures. Spatially relative terms can be intended to encompass different orientations of the device in use or operation in addition to the orientation depicted in the figures. For example, if the device in the figures is turned over, elements described as "below", or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

As depicted in FIGS. 1-10, training gloves 100 are shown. The training gloves can be configured to assist in teaching or training a user wearing the training gloves 100 to type on a keyboard. In certain examples, the keyboard can have a QWERTY keyboard layout. However, it should be appreciated that a skilled artisan can select keyboards with various layouts, characters, alphabets, symbols, indicia, or languages, as desired. It should be further appreciated that the keyboard can be a physical keyboard and/or a digital keyboard being rendered on a touch screen device, such as a tablet or mobile phone.

The training gloves 100 can be manufactured using textile fabrics or other materials. In certain examples, the training gloves 100 can have a soft texture to provide a calming experience for the user. However, it should be appreciated that one skilled in the art can manufacture the training gloves 100 from different materials, as desired. It should also be appreciated that the size of the training gloves 100 can be scaled according to a hand of the user, as discussed in greater detail hereinbelow. In certain embodiments, the gloves 100 may be adjustable and flexible such that it may be worn on a range of hand sizes.

Various materials for the training gloves 100 include stretchable or elastic materials, including materials that conform to portions of the hands of the user, as well as woven materials and breathable materials. In certain examples, the material for the training gloves 100 can be washable. As another non-limiting example, in certain embodiments, the material of the glove 100 may be treated with an antimicrobial product. The material of the training gloves 100 may be a breathable material adapted to keep the user dry during use, according to certain embodiments. Materials including cotton, spandex, elastane, nylon, polyester, polyester-vinyl, vinyl, and/or rayon can be used to fabricate the training gloves 100. The gloves 100 can be formed using a solid panel of material, a material having one or more openings, a mesh material, or any desirable combination of materials, weaves of material, and openings. A skilled artisan can select any suitable material or combination of materials for the training gloves 100, as desired.

The training gloves 100 can be a pair of gloves including a first glove 102 and a second glove 104. Each of the first and second gloves 102, 104 can have a main body 106 defined by a dorsal side 108 and a palmar side 110. The main body 106 can be configured to receive the hand of the user and a wrist of the user. The main body 106 can have one or more fit adjusting mechanisms for customizing and adjusting the size and fit of the first and second gloves 102, 104 on the user's hand, wrist, and forearm. As non-limiting examples, an adjustable strap, flap, zipper, button, elastic element, hook-and-loop fastener, or tie can be used to tighten or more securely fasten and hold the gloves 102, 104 in place, as desired.

In certain embodiments, the main body 106 can have one or more finger sheaths 112. Each finger sheath 112 can be in communication with the main body 106 and configured to receive a finger of the user. Each finger sheath 112 can have a proximal end 114 disposed adjacent to the dorsal side 108 and the palmar side 110 of the main body 106 of the glove 102, 104 and a distal end 116 disposed opposite the proximal end 114. Each finger sheath 112 can be integral with the glove 102, 104 or removably connected to the glove 102, 104.

In certain embodiments, the finger sheaths 112 can include a thumb sheath 118, a first finger sheath, a second finger sheath, a third finger sheath, and a fourth finger sheath. In certain embodiments, the finger sheaths 112 can be open at the distal end 116. Accordingly, fingertips of the user can be exposed when the glove 102, 104 is worn, as shown in FIGS. 3-4, such that each of the fingertips of the user can make direct contact with the keyboard 101, in operation. Each of the dorsal side 108 and the palmar side 110 of each of the first glove 102 and second glove 104 can have a plurality of characters, which correspond to characters, symbols, or any other indicia displayed on the keyboard, disposed thereon. Each of the characters can be disposed adjacent to one of the finger sheaths 112. In operation, the gloves 102, 104 can be worn by the user when learning to type. The character disposed on one of the keys can thereby indicate to the user which finger should be used to strike the corresponding key on the keyboard 101.

Each of the finger sheaths 112 can have a length. The length can correspond to a distance between the hand and the second knuckle of the hands of the user. It should be appreciated that the finger sheath should not extend beyond the second knuckles of the hands of the user because the characters disposed thereon may no longer be visible to the user, in operation.

In some embodiments, the dorsal side 108 of the first glove 102 can have a first set 120 of characters disposed thereon. The palmar side 110 of the first glove 102 can have a second set 122 of characters disposed thereon. The dorsal side 108 of the second glove 104 can have a third set 124 of characters disposed thereon. The palmar side 110 of the second glove 104 can have a fourth set 126 of characters disposed thereon. The first set 120 of characters and the third set 124 of characters are referred to collectively herein as the dorsal characters 128. The second set 122 of characters and the fourth set 126 of characters are referred to collectively herein as the palmar set 130 of characters.

Figure 1:
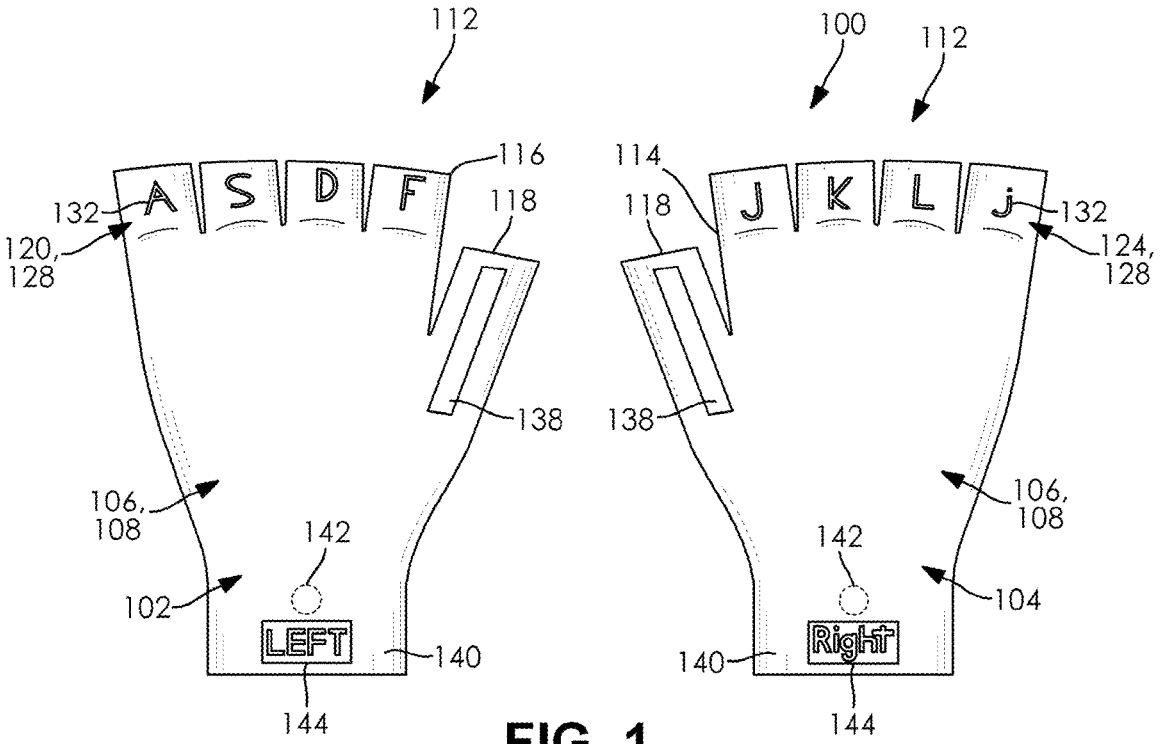
FIG. 1 is a top plan view of training gloves for typing including a first glove and a second glove, depicting the gloves in a first configuration, according to certain embodiments of the present disclosure.
Figure 2:
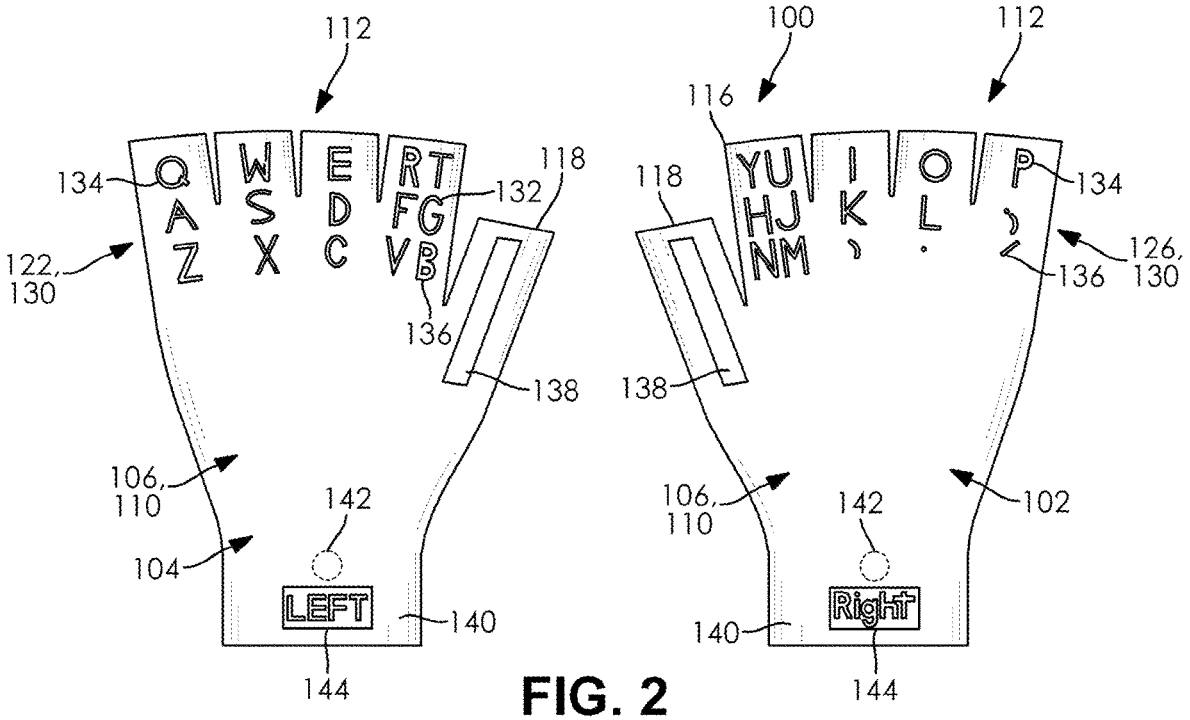
FIG. 2 is a top plan view of the training gloves including the first glove and the second glove, depicting the gloves in a second configuration.

The dorsal set of characters 128 can include home row characters 132 that correspond to the home row 103 on the keyboard. The palmar set of characters 130 can include top row characters 134 and bottom row characters 136, which correspond to the top row 105 of the keyboard 101 and the bottom row 107 of the keyboard 101, respectively, as well as the home row characters 132. Each character of the dorsal set of characters 128 and the palmar set of characters 130 can correspond and be disposed on/adjacent to one of the finger sheaths 112, according to touch-typing practice, for example, as shown in FIGS. 1-2.

In operation, the user wearing the training gloves 100 can easily ascertain which finger should contact each character on the keyboard 101. The thumb sheath 118 of each of the gloves 102, 104 can include a symbol 138, such as a rectangle, to depict the space bar on both the dorsal side 108 and the palmar side 110. It should be appreciated that one skilled in the artisan can select different characters for each of the dorsal side 108 and the palmar side 110 of the gloves 102, 104, within the scope of this disclosure.

It should be appreciated that the sets of characters 128, 130 can include any other symbols found on the keyboard. Desirably, this can allow a user to memorize the location of a key on the keyboard 101, as well as determining which finger should press which key. For example, the sets of characters 128, 130 can include characters from the number row of the keyboard 101. However, it should be appreciated that a skilled artisan can select any symbol for the sets of characters 128, 130, within the scope of this disclosure.

Each of the characters can have a second length. The second length can be selected based on the age and/or needs of the user. For example, younger users can require larger letter sizes. The second length can be from about ¼ of an inch to about ¾ of an inch. In certain non-limiting embodiments, the second length can be about ½ an inch. It should be appreciated that the second length of the first set of characters 128 can be different from the second length of the second set of characters, as desired. The second length can be smaller than the length of the finger sheath.

In operation, the training gloves 100 can be worn in a first configuration, shown in FIGS. 1 and 3, a second configuration, shown in FIGS. 2 and 4, and a third configuration. In the first configuration, the first glove 102 can be worn so that the dorsal side 108 of the first glove 102 covers a dorsal side of a first hand 109 of the user. The second glove 104 can be worn so that the dorsal side 108 of the second glove 104 covers the dorsal side of a second hand 111 of the user. This can permit a user to view the dorsal side 108 of the each of the training gloves 100 when typing. In the first configuration, the gloves 102, 104 can display the dorsal set of characters 128, when the user looks at the training gloves 100 while typing. In the second configuration, the gloves 102, 104 can be selectively flipped over or reversed so that the palmar sides 110 of the training gloves 100 face the user while typing on the keyboard 101. In particular, the first glove 102 can be worn so that the palmar side 110 of the first glove covers the dorsal side of the second hand 111 of the user. The second glove 104 can be worn so that the palmar side 110 covers the dorsal side of the first hand 109 of the user. This can allow the user to view the palmar side 110 of each of the training gloves 100, which displays the palmar set of characters 130, when the user looks at the training gloves 100 while typing.

In the third configuration, the user can turn the gloves inside out to view an interior surface of the first glove 102 and the second glove 104. The third configuration can be utilized by the user to practice without viewing any characters, or to practice with a select number of characters, as described in greater detail hereinbelow. In certain embodiments, the inner surface of the first glove 102 and the second glove 104 can also include characters on the dorsal side 108 and the palmer side 110, as discussed herein.

It should be appreciated that the user can selectively move between the first configuration and second configuration of the training gloves 100, as needed. For example, the user can start in the first configuration until mastering the dorsal set of characters 128; e.g., a home row on a keyboard. The user can then reverse the gloves to view the palmar set of characters 130 and to practice with additional characters. Advantageously, this allows the user to utilize one set of training gloves 100 while learning to type.

In certain embodiments, and in order to properly direct the user in operation, each of the first glove 102 and the second glove 104 can include a visual indicator 144 that allows the user to properly orient the gloves between the first configuration and the second configuration. In one non-limiting example, the dorsal side 108 of the first glove 102 can include the visual indicator 144 "LEFT" disposed thereon and the palmar side 110 of the first glove 102 can include the visual indicator 144 "RIGHT" disposed thereon. The dorsal side 108 of the second glove 104 can have the visual indicator 144 "RIGHT" disposed thereon and the palmar side 110 of the second glove 104 can have the visual indicator 144 "LEFT" disposed thereon. Advantageously, this can allow the user to ascertain the desired configuration of the training gloves 100.

In certain examples, the training gloves 100 can be customized by the user. For example, each one of the characters of each of the sets for characters 128, 130 can be selectively removed and attached or otherwise covered by user. Advantageously, this can allow the user to decide which symbols appear of which side of each of the training gloves 100. For example, in certain embodiments, the user can remove or cover the home row characters 132 on the palmar side 110 of each of the gloves 102, 104 so that only the top row characters 134 and the bottom row characters 136 are visible. It should be appreciated that the user can selectively remove or cover letters to assess mastery of certain characters, while allowing the user to uncover or reattach the letter if further practice is required.

The dorsal set of characters 128 and the palmar set of characters 130 can be displayed using different identifiers to further aid in memorizing which finger should be used for which key. For example, in some instances, the home row characters 132 can be presented in bold black font, which can allow the user to read the home row characters 132 more easily. In other instances, the home row characters, 132 the top row characters 134, and the bottom row characters 136 can each be displayed with in a different color. The color of each of the home row characters, 132 the top row characters 134, and the bottom row characters 136 can be displayed in a color that contrasts with the color of the main body 106 of each of the gloves 102, 104. Advantageously, this can allow the user to more easily see the characters.

The dorsal set of characters 128 and the palmar set of characters 130 can be displayed in various fonts. As non-limiting examples, the fonts can include Arial font and Times New Roman font. Advantageously, these fonts correspond the fonts utilized on most commercially available keyboards. The dorsal set of characters 128 and the palmar set of characters 130 can each be selectively displayed in uppercase or lower case. It should be appreciated that matching the case and font of the dorsal set of characters 128 and the palmar set of characters 130 to the commercial keyboard 101 of the user can further improve the ability of the user to learn the proper character and finger association.

In a first non-limiting example, the dorsal side 108 of each of the first glove 102 and the second glove 104 can include the dorsal set of characters 128 displayed in Arial font with capital letters. The palmar side 110 of each of the first glove 102 and the second glove 104 can include the palmar set of characters 130 displayed in Arial font with capital letters.

In a second non-limiting example, the dorsal side 108 of each of the first glove 102 and the second glove 104 can include the dorsal set of characters 128 displayed in Times New Roman font with lowercase letters. The palmar side 110 of each of the first glove 102 and the second glove 104 can include the palmar set of characters 130 displayed in Times New Roman font with lower case letters.

In certain embodiments, the inner surface of the first glove 102 and the second glove 104 can also include characters on the dorsal side 108 and the palmer side 110, as discussed herein. For example, the first glove 102 and the second glove 104 can be fabricated in accordance with the first non-limiting example, while the interior surface of the gloves 102, 104 can be fabricated according to the second non-limiting example. Advantageously, this can allow the user to utilize one set of training gloves with multiple keyboards 101.

In a further non-limiting example, the dorsal side 108 of each of the first glove 102 and the second glove 104 can include the palmar set of characters 130 displayed in Arial font with capital letters. The palmar side 110 of each of the first glove 102 and the second glove 104 can include the palmar set of characters 130 displayed in Times New Roman font with lower case letters. Advantageously, this example allows the user to utilize the training gloves with multiple keyboards 101.

With renewed reference to FIGS. 1-4, the main body 106 of each of the gloves 102, 104 can include a wristband 140 that circumscribes an opening of the main body. Each of the wristbands 140 of the gloves 102, 104 can have a magnet 142 disposed therein. The magnets 142 can allow the user to secure the gloves 102, 104 together. Advantageously, this can allow the user to more easily store the training gloves.

It should be appreciated that the training gloves 100 can include various elements that are configured to enhance an experience of the user. For example, the training gloves 100 can be fabricated from multiple colors, can include various designs, and can include glow-in-the-dark elements.

The present disclosure further contemplates a kit 200, for example, as shown in FIG. 5, for teaching a user how to type. The kit 200 can include the gloves 102, 104 as described hereinabove. The kit 200 can also include a plurality of adhesive decals 202. Each one of the plurality of adhesive decals 202 can be configured to be selectively and removably attached to the gloves 102, 104. The plurality of adhesive decals 202 can include covers for the characters. In operation, the user can use a cover decal to selectively cover a character to assess mastery of that character. The plurality of adhesive decals can include alphabet decals. In operation, the user can utilize the gloves 102, 104 in the third configuration, described hereinabove, and selectively and removable add letters which require further practice. Advantageously, the cover decals can allow the user to reversibly cover letters and the alphabet decals can allow the user to reversibly add letters to the inner surface of the gloves 102, 104. These adhesive decals 202 can be beneficial if the training gloves 100 are used in a classroom setting where each user may be at a different skill level as the kit 200 allows the gloves to quickly be customized between users having different skill levels.

In certain embodiments, the kit 200 can be configured to be used in a group learning setting, such as a classroom. Accordingly, the kit 200 can include multiple pairs of the gloves 102, 104 and the adhesive decals 202. The kit 200 can also be provided with instructional materials, which can include worksheets, lined paper, and a typing tutorial program.

The present disclosure further contemplates a method 300 of teaching a user to type, for example as shown in FIGS. 3-4 and 11. The method can include a step 302 of providing the gloves 102, 104. As described hereinabove the gloves 102, 104 can also be provided in the kit 200 including the adhesive decals 202.

The method 300 can include a step 304 of practicing typing with the training gloves 100 in the first configuration. In particular, the user can wear the first glove 102 on the first hand 109 and the second glove 104 on the second hand 111. In the first configuration, the user can view the first set of characters 120 and the third set of characters 124 while typing. This can allow the user to practice typing the home row characters 132.

The method 300 can include a step 306 of reversing the gloves 102, 104. In particular, the user can reverse the gloves 102, 104 from the first configuration to the second configuration. The user can wear the first glove 102 on the second hand 111 and the second glove 104 on the first hand 109. In the second configuration, the user can view the second set 122 of characters and the fourth set 128 of characters while typing. This can allow the user to practice typing the home row characters 132, the top row characters 134, and the bottom row characters 136. The method 300 can include a step 308 of practicing typing in the second configuration.

The method 300 can include a step 310 of testing mastery. The user can utilize the adhesive decals 202 to selectively cover certain letters, or the user can place the gloves 102, 104 in the third configuration and selectively add adhesive deals 202, as needed. It should be appreciated that the user can further practice without the use of the decals 202 in the third configuration. The user can also use only one glove 102, 104 in the third configuration, as needed. The user can then practice typing. The user can then repeat the practice steps 304, 208 as needed.

While certain representative embodiments and details have been shown for purposes of illustrating the invention, it will be apparent to those skilled in the art that various changes can be made without departing from the scope of the disclosure, which is further described in the following appended claims.

What is claimed is:

1. A training system for typing by a user on a QWERTY keyboard, comprising:

a first glove including:

a main body;

a plurality of finger sheaths, each of the finger sheaths configured to receive a finger from the user;

a first set of characters disposed on a dorsal side of the main body; and a second set of characters disposed on a palmar side of the main body;

wherein each character of the first set of characters and the second set of characters is disposed adjacent to one of the finger sheaths, each of the finger sheaths are open at a distal end, and the first set of characters includes different characters than the second set of characters, and wherein the first set of characters includes only home row characters of the QWERTY keyboard for visual display on the dorsal side of the main body and the second set of characters includes each of home row characters of the QWERTY keyboard, top row characters of the QWERTY keyboard, and bottom row characters of the QWERTY keyboard for visual display on the palmer side of the main body.

2. The training system of claim 1, further comprising:

a second glove including:

a second main body;

a second plurality of finger sheaths, each of the second plurality of finger sheaths configured to receive a second finger from the user;

a third set of characters disposed on a second dorsal side of the second main body; and a fourth set of characters disposed on a second palmar side of the second main body;

wherein each character of the third set of characters and the fourth set of characters is disposed adjacent to one of the finger sheaths of the second plurality of finger sheaths.

3. The training system of claim 2, wherein the first glove and the second glove are configured to be selectively moved between a first configuration and a second configuration.

4. The training system of claim 3, wherein the first configuration includes the first glove configured to be worn by the user such that the dorsal side of the main body covers a dorsal side of a first hand of the user, and the second glove configured to be worn by the user such that the second dorsal side of the second main body covers a second dorsal side of the second hand of the user, thereby permitting the first set of characters and the third set of characters to be viewed by the user when typing on the QWERTY keyboard.

5. The training system of claim 4, wherein the second configuration includes the first glove configured to be worn by the user such that the palmar side of the main body covers the dorsal side of the second hand and the second glove configured to be worn by the user such that the second palmar side of the second main body covers the second dorsal side of the first hand, thereby permitting the second set of characters and the fourth set of characters to be viewed by the user when typing on the QWERTY keyboard.

6. The training system of claim 1, wherein each of the finger sheaths terminates before a first knuckle of a user.

7. The training system of claim 2, wherein the first set of characters and the third set of characters include only home row characters of the QWERTY keyboard.

8. The training system of claim 7, wherein the second set of characters and the fourth set of characters includes home row characters, top row characters, and bottom row characters of the QWERTY keyboard.

9. The training system of claim 8, wherein the second set of characters and the fourth set of characters further includes the home row characters.

10. The training system of claim 1, wherein the first set of characters and the second set of characters are displayed in one of Arial font and Times New Roman font.

11. The training system of claim 2, wherein the main body of each of the first glove and the second glove includes a wrist band.

12. The training system of claim 2, wherein each of the first glove and the second glove include a visual indicator that allows the user to properly orient the gloves.

13. The training system of claim 3, wherein the first glove and the second glove are configured to be selectively moved between the first configuration, the second configuration, and a third configuration.

14. A kit for teaching typing to a user to use a QWERTY keyboard, the kit comprising:

a pair of training gloves including a first glove and a second glove, the first glove including a main body having finger sheaths, each of the finger sheaths configured to receive a finger from the user, the main body further including a dorsal side, a palmar side, the dorsal side having a first set of characters disposed thereon, the palmar side having a second set of characters disposed thereon, each character of the first set and the second set corresponding and disposed adjacent to one of the finger sheaths, wherein each of the finger sheaths are open at a distal end, wherein the first set of characters includes different characters than the second set of characters, and wherein the first set of characters includes only home row characters of the QWERTY keyboard for visual display on the dorsal side of the main body and the second set of characters includes each of home row characters of the QWERTY keyboard, top row characters of the QWERTY keyboard, and bottom row characters of the QWERTY keyboard for visual display on the palmer side of the main body, and the second glove including a second main body having a second set of finger sheaths, each of the second set of finger sheaths configured to receive a second finger from the user, the second main body further including a second dorsal side, a second palmar side, the second dorsal side having a third set of characters disposed thereon, the second palmar side having a fourth set of characters disposed thereon, each character of the third set and the fourth set corresponding and disposed adjacent to one of the second set of finger sheaths; and a plurality of adhesive decals, each of the adhesive decals configured to be removably disposed on one of the pair of training gloves.

15. The kit of claim 14, further comprising a plurality of pairs of training gloves.

16. A method for learning to type by a user on a QWERTY keyboard, comprising:

providing a pair of training gloves including a first glove and a second glove, the first glove including a main body having finger sheaths, each of the finger sheaths configured to receive a finger from the user, the main body further including a dorsal side, a palmar side, the dorsal side having a first set of characters disposed thereon, the palmar side having a second set of characters disposed thereon, each character of the first set and the second set corresponding and disposed adjacent to one of the finger sheaths, wherein each of the finger sheaths are open at a distal end, wherein the first set of characters includes different characters than the second set of characters, and wherein the first set of characters includes only home row characters of the QWERTY keyboard for visual display on the dorsal side of the main body and the second set of characters includes each of home row characters of the QWERTY keyboard, top row characters of the QWERTY keyboard, and bottom row characters of the QWERTY keyboard for visual display on the palmer side of the main body, and the second glove including a second main body having a second set of finger sheaths, each of the second set of finger sheaths configured to receive a second finger from the user, the second main body further including a second dorsal side, a second palmar side, the second dorsal side having a third set of characters disposed thereon, the second palmar side having a fourth set of characters disposed thereon, each character of the third set and the fourth set corresponding and disposed adjacent to one of the second set of finger sheaths;

typing with the training gloves in a first configuration;

reversing the gloves to a second configuration; and typing with the gloves in the second configuration.

17. The training system of claim 2, wherein the third set of characters and the first set of characters includes a different character than the second set of characters.

18. The training system of claim 2, wherein the fourth set of characters includes the first set of characters and the third set of characters includes the second set of characters.

19. The training system of claim 1, wherein the second set of characters includes other symbols found on the QWERTY keyboard.

20. The training system of claim 12, wherein the visual indicator is disposed on the dorsal side of the first glove, the palmar side of the first glove, the second dorsal side of the second glove, and the second palmar side of the second glove.

* * * * *